US008317669B2

(12) United States Patent
Sato

(10) Patent No.: US 8,317,669 B2
(45) Date of Patent: Nov. 27, 2012

(54) ELASTIC ROLLER AND METHOD OF GRINDING THE SAME

(75) Inventor: Junichiro Sato, Kanagawa (JP)

(73) Assignee: Bridgestone Corporation, Tokyo (JP)

( * ) Notice: Subject to any disclaimer, the term of this patent is extended or adjusted under 35 U.S.C. 154(b) by 1234 days.

(21) Appl. No.: 11/772,846

(22) Filed: Jul. 3, 2007

(65) Prior Publication Data

US 2008/0096472 A1 Apr. 24, 2008

(30) Foreign Application Priority Data

Jul. 6, 2006 (JP) ..... 2006-186529

(51) Int. Cl.
*B25F 5/02* (2006.01)
*B24B 1/00* (2006.01)

(52) U.S. Cl. ..... 492/56; 451/49; 451/51

(58) Field of Classification Search ..... 492/60; 451/28–63, 179, 182, 69
See application file for complete search history.

(56) References Cited

U.S. PATENT DOCUMENTS 3,998,681 A * 12/1976 Williams et al. ..... 156/154
5,206,992 A * 5/1993 Carlson et al. ..... 29/895.32
5,303,512 A * 4/1994 Tsujiuchi et al. ..... 451/49
5,766,059 A * 6/1998 Imai et al. ..... 451/49
7,452,263 B2 * 11/2008 Itoh et al. ..... 451/11

FOREIGN PATENT DOCUMENTS

JP 09-029843 A 2/1997
JP 09029843 A * 2/1997
JP 2002-132041 A 5/2002
JP 2002132041 A * 5/2002

* cited by examiner

*Primary Examiner* — David Bryant
*Assistant Examiner* — Jacob Cigna
(74) *Attorney, Agent, or Firm* — Sughrue Mion, PLLC

(57) ABSTRACT

When an elastic layer surface having an unapplied area of adhesive agent at its one end is ground, a method of grinding an elastic roller which assures high run-out accuracy and uniform diameter as well as which can carry out surface grinding with good production efficiency is provided.

An elastic roller comprises an elastic layer 1 carried on the outer circumference of a shaft 2 via adhesive agent, and an unapplied area of adhesive agent at one end of the elastic layer in the longitudinal direction of the roller. The surface of the elastic layer is ground by a grindstone 10 moving along the longitudinal direction of the roller. The elastic layer has no taper at the both ends, and grinding carried out by the grindstone is started from an opposite end side of the end having the unapplied area of adhesive agent of the roller in the longitudinal direction.

3 Claims, 1 Drawing Sheet

ELASTIC ROLLER AND METHOD OF GRINDING THE SAME

BACKGROUND OF THE INVENTION

1. Field of the Invention

The present invention relates to an elastic roller and a method of grinding the same (hereinafter, simply referred to as "method of grinding"), more specifically to an elastic roller used for various roller material in an image forming apparatus such as copying apparatus, printer, and facsimile apparatus and the like, and a method of grinding the elastic roller.

2. Related Art

In image forming apparatuses using electrophotographic system such as copying apparatus, printer, and facsimile apparatus of an electrophotographic system, elastic rollers applied conductivity such as, transfer roller, developing roller, toner supply roller, conductive roller, cleaning roller, intermediate transfer roller, belt drive roller, etc. are used for each process in image forming. In order to obtain desired roller performance, high dimensional accuracy, surface accuracy, run-out accuracy and so on are demanded in such elastic rollers.

Such elastic rollers typically have a structure including an elastic layer carried on the outer circumference of the shaft via adhesive agent, and rubber or resin is used for the material of the elastic layer. Furthermore, foam elastic rollers using expanded rubber or resin foam are also widely used for the elastic layer, especially, the most typical one is a polyurethane foam roller which the elastic layer is constructed by polyurethane foam.

When manufacturing the elastic roller, usually an elastic layer is formed in cylindrical shape by mold-making, injection molding, extrusion molding, etc., and then the surface of the molded elastic layer roller is ground and its ends are cut in order to secure accuracy. Thus, for the purpose of preventing the elastic layer from remaining and the shaft from being damaged, there are some cases that an area where is not applied adhesive agent is provided on ends, which are cut portions, of the elastic layer, for example, as disclosed in Japanese Published Unexamined Patent Application No. H9-29843. In addition, since the elastic layer is sometimes disturbance during assembling a cartridge, for the purpose of making the elastic layer end movable, there are some cases that an area where is not applied adhesive agent is provided at the ends.

However, in case that an unapplied area of adhesive agent is provided at the ends of the elastic layer, when the surface of an elastic layer 1 is ground, as shown in FIG. 3, there are some cases in which the elastic layer 1 is pressed by a grindstone 10 at an unapplied area of adhesive agent A from the beginning of the grinding process, so that the elastic layer 1 is ground with being significantly lifted up from a shaft 2, which results in less diameter of the unapplied area of adhesive agent A than a target size. This causes problems that a uniform roller diameter in shaft direction could not be obtained, so that run-out accuracy is degraded. A numeral 20 in the figure shows supporting members of the shaft 2.

Meanwhile, to solve this problem, when the surface of the elastic layer 1 is ground, a technique in which the grind speed at the unapplied area of adhesive agent A is made slower than other areas so as to enhance processing accuracy to obtain a roller having a uniform roller diameter in shaft direction and high run-out accuracy is proposed, however, this method has a problem of poor production efficiency due to longer processing time.

When a roller having poor diametric accuracy and run-out accuracy is used, for example, for a toner supply roller in the electrophotographic process, a developing roller is not uniformly supplied with toner in shaft direction as well as that extra toner which has not been supplied from the developing roller to a photoconductor drum is not uniformly scraped in shaft direction, which results in the cause of poor image quality. Accordingly, for the elastic layer having the unapplied area of adhesive agent at the end, there has been a demand for a technique which can carry out a surface grinding with keeping high run-out accuracy and uniform diameter, and furthermore, does not reduce production efficiency.

SUMMARY OF THE INVENTION

It is therefore, an object of an illustrative, non-limiting embodiment of the present invention to provide an elastic roller which solves the above-mentioned problems, keeps high run-out accuracy and uniform diameter when the elastic layer surface having the unapplied area of adhesive agent at the end is ground, and provides good production efficiency of surface grinding, and a method of grinding the elastic roller.

As a result of keen examination, the present inventor completed the present invention after finding that the following structure prevents nonuniform diameter and poor run-out accuracy of an elastic roller even in case of having an unapplied area of adhesive agent, and does not reduce production efficiency at the same time.

In other words, in an aspect of the invention, an elastic roller includes an elastic layer carried on the outer circumference of a shaft via adhesive agent, and an unapplied area of the adhesive agent at one end in the longitudinal direction of the roller of the elastic layer, whose outer circumference of the elastic layer is ground by a grindstone moving along the longitudinal direction of the roller, wherein the elastic layer has no taper at the both ends of the roller in the longitudinal direction, and grinding by the grindstone is started from an opposite end side of the end having the unapplied area of adhesive agent in the longitudinal direction of the roller.

In the elastic roller according to the invention, it is preferred that a mark to visually identify the unapplied area side of the adhesive agent is provided on the shaft and/or the elastic layer. Furthermore, in the elastic roller according to the invention, when grinding by reciprocating the grindstone at least once along the longitudinal direction of the roller, the elastic roller is ground by reversing the grindstone with the grindstone and the end in contact with each other along the longitudinal direction of the roller at the end having the unapplied area of the adhesive agent of the elastic layer. Moreover, in the elastic roller according to the invention, the elastic layer is preferably a polyurethane foam roller comprising polyurethane foam, and the unapplied area of adhesive agent is preferably within the range of 5 to 10 mm from the end of the elastic layer.

In addition, in another aspect of the invention, a method of grinding an elastic roller has an elastic layer carried on the outer circumference of the shaft via adhesive agent, and an unapplied area of adhesive agent at one end in the longitudinal direction of the roller of the elastic layer, in which the outer circumference of the elastic layer is ground by a grindstone moving along the longitudinal direction of the roller, wherein grinding by the grindstone is started from an opposite end side of the end having the unapplied area of adhesive agent in the longitudinal direction of the roller.

In the method of grinding the elastic roller according to the invention, when grinding by reciprocating the grindstone at least once along the longitudinal direction of the roller, it is preferable to reverse the grindstone, with the grindstone and the end in contact with each other along the longitudinal direction of the roller at the end having the unapplied area of adhesive agent of the elastic layer. Moreover, the elastic roller according to the invention in which the elastic layer is preferably a polyurethane foam roller comprising polyurethane foam, and the unapplied area of adhesive agent is preferably within the range of 5 to 10 mm from the end of the elastic layer.

According to the present invention, the above-mentioned structure achieves an elastic roller which assures high run-out accuracy and uniform diameter, even if the elastic roller includes an elastic layer having an unattached portion to a shaft at an end. Furthermore, according to the present invention, a method of grinding an elastic roller which assures high run-out accuracy and uniform diameter, and grinds an elastic layer surface with good production efficiency is also accomplished, even if the elastic roller includes an elastic layer having an unattached portion to a shaft at an end.

DESCRIPTION OF THE PREFERRED EMBODIMENTS

Figure 1:
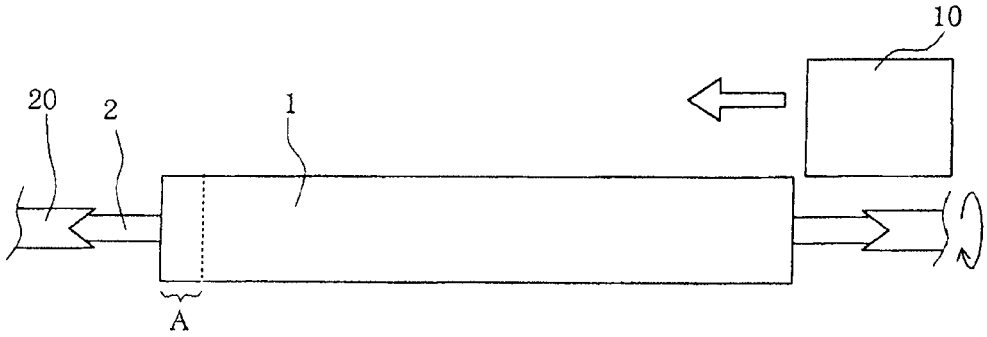
FIG. 1 is a schematic diagram showing a method of grinding an elastic roller of the present invention

Described below is a detailed explanation of a preferred embodiment of the present invention. FIG. 1 shows a schematic diagram with respect to a method of grinding an elastic roller of the present invention. As shown in the figure, a method of grinding an elastic roller of the present invention is a method of grinding the elastic roller which has an elastic layer 1 carried on the outer circumference of a shaft 2 via adhesive agent, and an unapplied area of the adhesive agent A at one end in the longitudinal direction of the roller of the elastic layer 1.

In the present invention, when a grinding process using a grindstone 10 along with the longitudinal direction of the roller to the surface of the elastic layer 1 is performed, it is very important to start grinding with the grindstone 10 from the opposite end of the end at which the unapplied area of adhesive agent A is provided of the longitudinal direction of the roller as shown in the figure, that is, to start from the end integratedly formed by the elastic layer 1 and the shaft 2 via adhesive agent. This enables elastic layer to be ground while ensuring uniform diameter in the roller shaft direction and high run-out accuracy even if the roller has the unapplied area of adhesive agent A, and does not reduce production efficiency.

In the method of grinding of the present invention, as mentioned above, only the point that to start grinding with the grindstone 10 from the opposite end of the end on which the unapplied area of adhesive agent A is provided is important, but other points are carried out appropriately in accordance with common procedure, and not specifically limited. For example, in the present invention, the surface of the elastic layer 1 is ground in the manner that the elastic roller is held by supporting member 20 through the shaft 2 with being rotationally driven, the surface is pressed to the grindstone 10 while it is being moved along the longitudinal direction of the roller. Conditions such as the revolution of the elastic roller and the revolution and movement speed of the grindstone 10 are appropriately decided depending on a target amount of grinding, material of the elastic layer, polishing mark roughness of the grindstone 10, etc., and not specifically limited.

Figure 2:
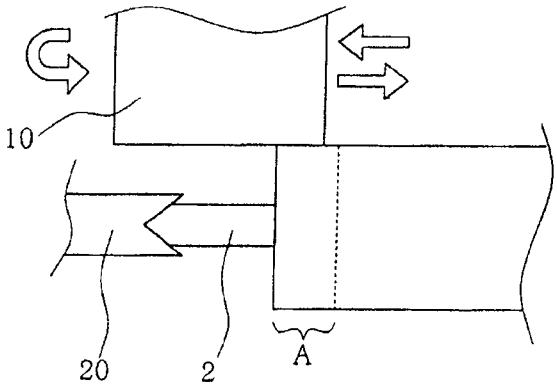
FIG. 2 is an explanatory diagram showing a condition of when a grindstone is turning back.
Figure 3:
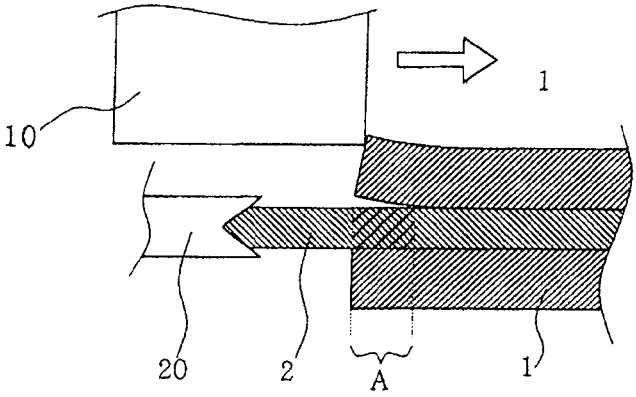
FIG. 3 is a cross-sectional view showing a condition in which an elastic layer is lifted up when an elastic roller is ground.

Furthermore, typically, the surface of the elastic layer 1 is ground by reciprocating the grindstone 10 at least once along the longitudinal direction of the roller, and in this case, as shown in FIG. 2, it is preferred that grindstone 10 is reversed at the end having the unapplied area of adhesive agent A of the elastic layer 1, with the grindstone 10 and the end of the elastic layer 1 in contact with each other in the longitudinal direction of the roller. By reversing the grindstone 10 with holding the grindstone 10 together with the end of the elastic layer 1 to reciprocate, the lifting up of the elastic layer 1 seen in FIG. 3 is solved on the reverse of the grindstone 10, which effectively prevents the degrade of the uniformity of diameter and run-out accuracy. In this regard, it is effective and preferable to use a grindstone which is sufficiently wider than the unapplied area of adhesive agent A. A grindstone with narrow width may cause contact pressure and furthermore, nonuniform diameter after grinding, since the unapplied area of adhesive agent misaligned for the rotating direction when grinding. Specifically, a grindstone which is 5 to 10 times wider than the unapplied area A is used, for example.

The method of grinding of the present invention can be applied to general elastic rollers having the structure which carries a conductive elastic layer around the conductive shaft, and such elastic layer is typically formed in cylindrical shape by mold-making, injection molding, extrusion molding and so on. The material of the elastic layer is not specifically limited, but the application of the present invention to, for example, a polyurethane foam roller having an elastic layer comprising polyurethane foam which is flexible and has a tendency that run-out of the diameter occurs during grinding is effective. In addition, the unapplied area of adhesive agent A is typically provided within the range of 5 to 10 mm from the end of the elastic layer 1, a case where the unapplied area of adhesive agent A is provided out of the range is also applicable in the present invention, and not specifically limited.

The elastic roller of the present invention comprises an elastic layer 1 carried on the outer circumference of a shaft 2 via adhesive agent, and an unapplied area of the adhesive agent A at one end in the longitudinal direction of the roller of the elastic layer 1, and is accomplished by the above-mentioned method of grinding of the present invention, and it is characterized in that the elastic layer 1 has no taper at the both ends of the roller in the longitudinal direction as shown in the figure. Since the roller can achieve high run-out accuracy and uniform diameter by the above-mentioned method of grinding, for example, when the roller is used as a toner supply roller, it can perform uniform toner supply and scraping, preventing the occurrence of poor image quality.

Additionally, in the roller of the present invention, since the unapplied area of adhesive agent A is provided only at one side and the other end is attached, for example, when the elastic roller is incorporated in a cartridge as a toner supply roller and then is rotated, it can seal a portion where tends to have toner leakage. In contrast, the provision of the unattached area at both ends of the roller makes the roller movable, so that toner leakage occurs. Moreover, since the unapplied area A is provided at only one end although the roller is ground, and the ends of the elastic layer have no taper, an area where can be used for a toner supply roller can be kept widely in the longitudinal direction.

It is preferred that in the elastic roller of the present invention, a mark enabling visual identification of the unapplied side of the adhesive agent is provided on the shaft 2 and/or elastic layer 1. This enhances the handling performance on incorporating, and there is an advantage that the start direction of grinding is easy to find by providing the mark before grinding. There is no specific limitation for such mark, provided that it is visually identify it. For example, a mark can be made by providing a cutout at the end of the shaft, or by changing the length of the shaft extruding to the end of the elastic layer.

The following examples are given for the purpose of illustrations of this invention and are not intended as limitation thereof.

Referential Example, Comparative Examples 1, 2 and Example

An elastic roller which comprises an elastic layer 1 (length: 200 to 300 mm) including polyurethane foam that is carried on the outer circumference of the shaft 2 via adhesive agent (Daicel Chemical Industries, Thermolite 6501) and, an unapplied area of adhesive agent at one end of the elastic layer 1 in the longitudinal direction of the roller was fabricated, and the surface of the elastic layer 1 is ground by a grindstone 10 moving along the longitudinal direction of the roller. Specifically, the range of unapplied area of adhesive agent A on the elastic roller was changed for each example as seen in Table 1 below, while the surface of the elastic layer 1 was ground by the use of grindstone 10 under different starting points where is the end having the unapplied area of adhesive agent in the longitudinal direction of the roller (unattached side, Comparative example), or the opposite end (attached side, Embodiment), and then run-out accuracies of the elastic layer surface of the roller after grinding were compared to evaluate. Also, an elastic roller without the unapplied area of adhesive agent A (unapplied area 0 mm) was fabricated and ground to evaluate run-out accuracy (Referential example).

(Grinding Conditions)

Grinding machine: Minakuchi grinding machine, LE0600-F2 (CNC type)

Grindstone: GC80 (grind stone width: 50 mm, TEIKEN)

Roller supporting member: Used reverse center

Grinding conditions: Grind stone revolution: 1000 to 2000,

Roller revolution: 200 to 400

Revolution, traverse (grind stone movement) speed 500 to 3000 (mm/sec)

(Run-Out Test Conditions)

Sizer: Mitsutoyo laser dimension measuring apparatus

Three measuring points are determined in the longitudinal direction of the roller and the run-out average of these Measuring point 1-3 are measured to detect the maximum value of run-out. Regarding the criterion of run-out accuracy, Maximum run-out 0.35 mm or less is judged as "Pass", and values above are judged as "Fail". The results are shown in Table 2.

TABLE 1

| | Unapplied area of adhesive agent (mm) | Grind starting point |
|---|---|---|
| Referential example | 0 | Attached side |
| Comparative example 1 | 5 | Unattached side |
| Comparative example 2 | 10 | Unattached side |
| Example | 10 | Attached side |

TABLE 2

| | Average run-out (mm) | | | Maximum | |
|---|---|---|---|---|---|
| | Measuring point 1 | Measuring point 2 | Measuring point 3 | run-out (mm) | Judgment |
| Referential example | 0.130 | 0.128 | 0.141 | 0.294 | Pass |
| Comparative example 1 | 0.174 | 0.155 | 0.144 | 0.354 | Fail |
| Comparative example 2 | 0.165 | 0.155 | 0.156 | 0.369 | Fail |
| Example | 0.137 | 0.139 | 0.144 | 0.300 | Pass |

As seen from the above Table 1, 2, the smaller the range of the unapplied area of adhesive agent A is, the smaller the run-out of roller obtains better results. On the other hand, Example where the grinding start point had been changed from the unattached side to the attached side accomplished a high run-out accuracy as approximately same as the run-out accuracy of the grinding roller of Referential example which has no unapplied area of adhesive agent, even though it had 10 mm of unapplied area of adhesive agent. According to these results, the enhancement of uniform diameter and run-out accuracy in the shaft direction of the elastic roller was made sure by setting the grinding start point to the opposite side of the unapplied area of adhesive agent.

What is claimed is:

1. A method of grinding an elastic roller which has an elastic layer carried on the outer circumference of a shaft via an adhesive agent, and an unapplied area of adhesive agent at only one end in the longitudinal direction of the roller of said elastic layer, in which the outer circumference of said elastic layer is ground by a grindstone moving along the longitudinal direction of the roller, wherein grinding by said grindstone is started from an opposite end side of the end having the unapplied area of adhesive agent in the longitudinal direction of the roller, wherein when grinding by reciprocating said grindstone at least once along the longitudinal direction of the roller, reversing said grindstone, with said grindstone and the end having the unapplied area of adhesive agent of said elastic layer in contact with each other along the longitudinal direction of the roller.

2. The method of grinding the elastic roller according to claim 1, wherein said elastic layer is a polyurethane foam roller comprising polyurethane foam.

3. The method of grinding the elastic roller according to claim 1, the unapplied area of said adhesive agent is within a range of 5 to 10 mm from the end of said elastic layer.

* * * * *